United States Patent [19]

Mucheyer et al.

[11] 4,421,012

[45] Dec. 20, 1983

[54] CONTROL CIRCUIT THROTTLING VALVE

[75] Inventors: Norbert Mucheyer, Rechtenbach; Heinz Schulte, Marktheidenfeld, both of Fed. Rep. of Germany

[73] Assignee: G. L. Rexroth GmbH, Lohr, Fed. Rep. of Germany

[21] Appl. No.: 234,433

[22] Filed: Feb. 13, 1981

[30] Foreign Application Priority Data

Feb. 15, 1980 [DE] Fed. Rep. of Germany ..... 3005755

[51] Int. Cl.[3] ..... F15B 13/16

[52] U.S. Cl. ..... 91/388; 251/205; 251/209

[58] Field of Search ..... 91/388; 251/215, 205, 251/209

[56] References Cited

U.S. PATENT DOCUMENTS 1,967,851 7/1934 Wilson ..... 251/215

3,215,045 11/1965 Lissau ..... 91/388

4,094,229 6/1978 Leonard ..... 91/388

*Primary Examiner*—Paul E. Maslousky

*Attorney, Agent, or Firm*—Oblon, Fisher, Spivak, McClelland & Maier

[57] ABSTRACT

A control circuit throttling valve provided as a controlled dimension receiver in a hydraulic circuit for the control of a final control element, particularly for the control of a lifting unit of a tractor. The valve performs a receiver function under control of a mechanical coupling coupled to a moving part of the final control element which changes the valve throttling section and is adjustable and includes a casing having a control connection and a discharge connection and a movable throttling body provided in the casing in relation to the control connection and the discharge connection such that upon linear or rotational movement of the body it is possible to independently derive an adjusting function and a receiving function.

8 Claims, 3 Drawing Figures

CONTROL CIRCUIT THROTTLING VALVE

BACKGROUND OF THE INVENTION

Field of the Invention

This invention relates to a control circuit throttling valve provided as a controlled dimension receiver in a hydraulic circuit for the control of a final control element, particularly of a lifting unit of a tractor. More particularly, this invention relates to a control circuit throttling valve of the above-noted type which is adjustable and performs a receiver function by means of a mechanical coupling with the moving part of the final control element which changes the throttling position.

The throttling valve must accomplish two tasks:

On the one hand, the pressure medium flow must be throttled as a function of the position of a lifting unit and on the other hand, the throttling position must be adjustable to the circuit.

SUMMARY OF THE INVENTION

Accordingly, the objects of this invention are to provide a novel control circuit throttling valve which reliably accomplishes the above two noted functions while occupying the least amount of space and while having a structural design which is as simple as possible.

These and other objects are achieved according to the invention by providing a new and improved control circuit throttling valve of the above-noted type, wherein the adjusting function and the receiving function of the control circuit throttling valve can be accomplished by a single movable throttling body within a throttling casing under mutual disconnection of the functions.

Owing to the provision of a single throttling body in the throttling valve, the unit size is kept small. Additionally, the mutual disconnection of the adjusting function and the receiving function has the advantage that the movements of the throttling body are not superimposed and the quality of the receiver function can be maintained at the same level during all operational conditions independently of the basic adjustment.

In the preferred embodiment, the throttling valve according to the invention includes a piston which can be rotated and shifted within the throttling casing between a control connection and a discharge connection. In this embodiment, the throttling body has a control surface in a center section thereof by means of which the controlled connection is changable in a passage area thereof upon the shifting and/or rotating of the piston.

With regard to this embodiment, it is noted that a cylindrical body guided in a cylinder, has with its simple shape, the necessary degrees of freedom of movement, which are disconnected from each other, to control the throttling effect as a function of the two input informations.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
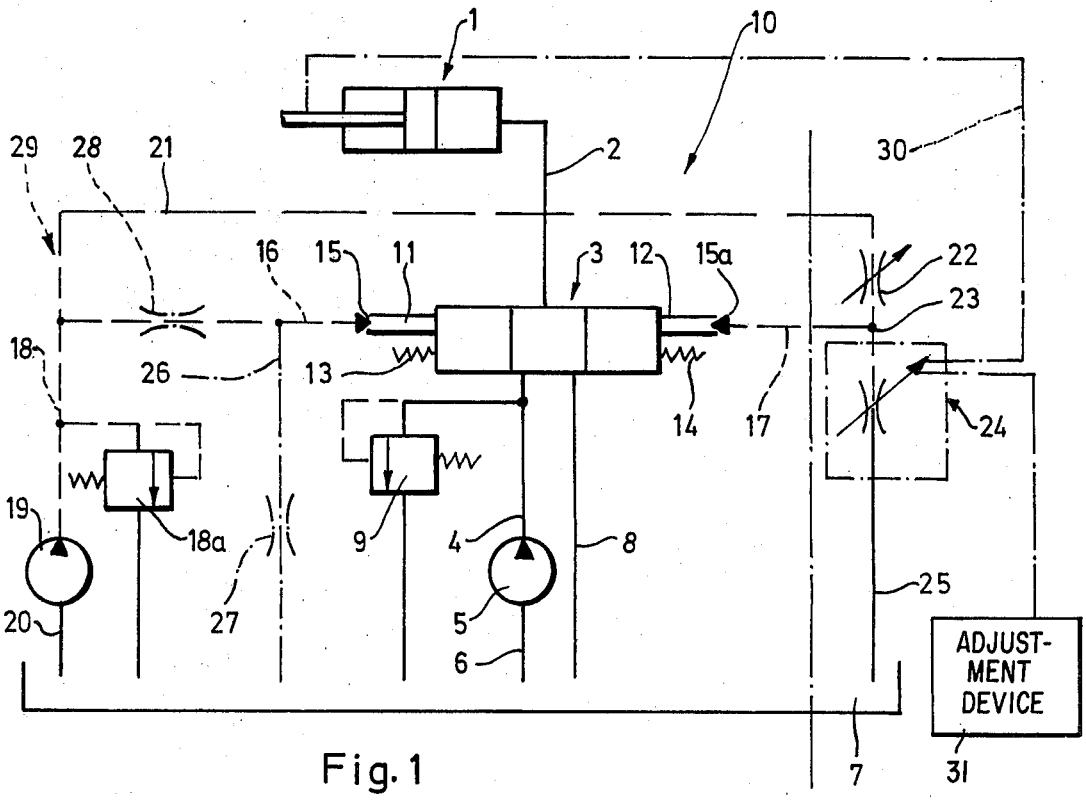
FIG. 1 is a schematic hydraulic diagram of a circuit for a hydraulic final control element provided with an integrated throttle valve according to the invention.

Referring now to the drawings, wherein like reference numerals designate identical or corresponding parts throughout the several views, and more particularly to FIG. 1 thereof, FIG. 1 shows a final control element 1 actuated by an operating circuit consisting of the elements 1 to 9, which is designed as a single-acting cylinder and connected with a 3/3-way valve 3, which can be actuated in both directions by means of pressure, over a line 2. A pump 5 is connected to the 3/3-way valve 3 over a line 4. Pump 5 has a suction line 6 extending to a storage container 7, and is coupled via a line 8 to the storage container 7. The line 4 is connected to a pressure limiting valve 9 whose outlet side is connected to the storage container 7.

For the actuation of its slide which is not shown, the 3/3-way valve 3 has control devices 11 and 12 arranged on both sides which, when a pressure medium (fluid or gas) acts upon them, attempt to shift the slide against the force of one of the control springs 13, 14 in the direction of the arrow 15, **15*a* in the control device 11 or 12. The two control springs 13, 14 attempt to maintain the slide in its center position when the control devices 11, 12 are not acted upon. A control line 16 is connected to the control device 11 and a control line 17 to the control device 12. The control line 16 is in communication with a control line 18 which is connected to the delivery side of a control pump 19 having a suction line 20 connected with the storage container 7. A pressure limiting valve 18*a* connected with the storage container 7 is connected to the control line 18. A control line 21 is connected to the control line 18 and leads to an adjustable throttle 22. From the adjustable throttle 22, a control line 23 leads to a control circuit throttling valve 24 which is connected to the storage container 7 by a line 25. The control line 23 is connected with the control line 17. The number 29** is assigned to the control circuit.

The adjustable throttle 22 is designed as a rated value indicator and the control circuit throttling valve 24 as a control dimension receiver which is connected with the moving part of the final control element 1 through a mechanical coupling 30.

A differential pressure developing between both sides of the 3/3-way valve 3 by means of the adjusting of the adjustable throttle 22 effects a shifting of the 3/3-way valve 3 thereby the final control element 1 is shifted while connected to the operating circuit 10. The mechanical coupling 30 leads the shifting back to the control circuit throttling valve 24 whereby the differential pressure changes between the two sides of the 3/3-way valve 3 and the final control element 1 is separated from the operating circuit 10 after repeated shifting of the 3/3-way valve 3 and is maintained in a certain adjusted position.

Figure 2:
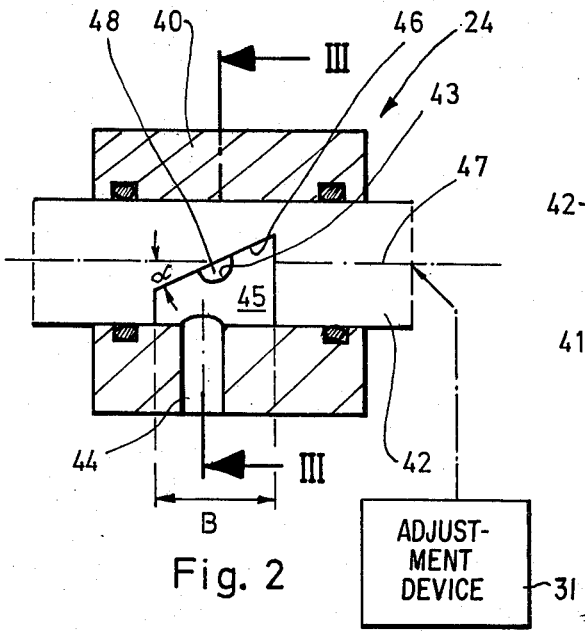
FIG. 2 is an axial cross-sectional view taken through the throttle valve according to the invention shown in FIG. 1; and, FIG. 3 is a cross-sectional view taken along the lines III—III shown in FIG. 2.
Figure 3:
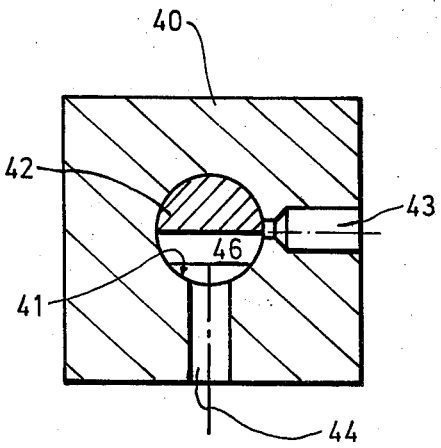

FIGS. 2 and 3 show a design of the control circuit throttling valve 24 according to FIG. 1. The control circuit throttling valve 24, hereinafter called briefly throttling valve, has a casing 40 with a casing borehole 41 into which a throttling body, 42 is led in a sealing manner. The casing 40 has, as can be noted from FIG. 1, a control connection 43 for the control line 23 and a discharge connection 44 to the line 25 and to the storage container 7. The control connection 43 as well as the discharge connection 44 are designed as boreholes running radially towards the casing borehole 41 and are at an angle of 90° towards each other.

In the area of the control and of the discharge connections, the body 42, which generally has a cylindrical shape has a recess 45 which is designed in such a fashion that it has an inner control surface 46 which runs at a certain angle $\alpha$ towards the longitudinal axis 47 of the body 42. In the shown exemplified embodiment, the body 42 is in a throttle center position. The control surface 46 is, in this instance, in parallel to the axis of the control connection 43 and it covers half of its passage area 48.

The width B of the recess 45 is of such a size in the shown case that the passage area 48 can be placed into the completely open condition in an infinitely variable manner in the shown position with the axial shifting of the body 42.

A mechanical coupling 30 (cf. FIG. 1) engages the body 42 and selectively actuates either a rotational or a linear movement of the body 42 as a function of the position of the final control element 1. On the other hand, the other movement not actuated by the mechanical coupling 30 is utilized for the purpose of adjusting position of cylindrical body 42 by means of an adjustment device 31.

Under the assumption that the mechanical coupling 30 transfers a linear motion to the body 42 for actuation of the valve 24, the body 42 is adjusted into a certain aligned position by means of the adjustment device 31 which acts in a rotary manner and is secured in this position against further rotating. In this way, the largest possible degree of opening of the passage area 48 is determined. Linear movement of the body 42 is then necessary for the changing of the passage area 48 to be determined. One can proceed in an analogous manner when the mechanical coupling 30 transfers a rotating motion to the body.

The lift (linear or rotational lift) required for the closing of the passage area 48 can be freely selected with a given diameter of the passage opening 48 by means of the selection of the angle of inclination $\alpha$ of the control surface 46 whereby the sensitivity of the adjustment or control function of the throttling valve can be adjusted.

Obviously, numerous modifications and variations of the present invention are possible in light of the above teachings. It is therefore to be understood that within the scope of the appended claims, the invention may be practiced otherwise unless specifically described herein.

What is claimed as new and desired to be secured by Letters Patent of the United States is:

1. A control circuit throttling valve defining a valve throttling section provided as a controlled dimension received in a hydraulic circuit for the control of a final control element, wherein said valve is adjustable and performs a receiver function under control of a mechanical coupling coupled to a moving part of the final control element which changes the valve throttling section, comprising:

a casing having a control connection and a discharge connection; and a single movable throttling body received in a sealed manner provided in said casing and capable of linear movement and rotational movement within said casing, said body having a control surface formed a sealed throttling space between the throttling body and the inner surface of the casing located relative to said control and discharge connections such that rotational movement and linear movement of said body independently control the opening degree of communication between said control and discharge connections;

wherein the receiver function is effected by selecting one of said rotational and linear movements and implementing the selected of said movements of said body, and an adjusting function is implemented by selecting the other of said rotational and linear movements and implementing the other movement of said body.

2. A throttling valve according to claim 1, comprising:

said throttling body having a cylindrical shape and adapted to be rotated and shifted in the throttling casing between said control connection and said discharge connection, said throttling body having a center defining said control surface by means of which a passage area of the control connection is changable upon selected movement of the throttling body.

3. A throttling valve according to claim 2, further comprising:

said throttling body defining a longitudinal axis, and said control surface of said throttling body inclined at a predetermined angle relative to the longitudinal axis by means of which the passage area of the control connection can be enlarged or reduced by selected movement of the throttling body.

4. A throttling valve according to claim 3, wherein said adjusting function is achieved by a rotational movement of the throttling body.

5. A throttling valve according to claim 3, wherein the adjusting function is achieved by means of a linear movement of the body.

6. A throttling valve according to claim 3, further comprising:

said throttling body having a freely selectable maximum linear range and maximum angular rotational range determined by the selection of the angle of the inclination of the control surface to the longitudinal axis of said throttling body for a predetermined diameter of the passage area of the control connection.

7. A throttling valve according to claim 4, further comprising:

said throttle body having a freely selectable maximum linear range and a maximum angular rotational range determined by the selection of the angle of the inclination of the control surface to the longitudinal axis of the throttling body for a predetermined diameter of the passage area of the control connection.

8. A throttling valve according to claim 5, further comprising:

said throttling body having a freely selectable maximum linear range and a maximum angular rotational range determined by the selection of the angle of the inclination of the control surface to the longitudinal axis of the throttling body for a predetermined diameter of the passage are of the control connection.

* * * * *